United States Patent [19]

Ruggles

[11] 4,374,588

[45] Feb. 22, 1983

[54] ISOKINETIC EXERCISE DEVICE WITH SPEED CONTROL

[75] Inventor: Roger Ruggles, Blue Springs, Mo.

[73] Assignee: Isokinetic Sales Co., Independence, Mo.

[21] Appl. No.: 216,326

[22] Filed: Dec. 15, 1980

[51] Int. Cl.[3] ..... A63B 21/32

[52] U.S. Cl. ..... 272/132; 272/125; 192/93 A

[58] Field of Search ..... 272/67, 131, 132; 188/82.84, 82.4, 130, 83, 71.2, 82.9; 192/93 A, 111 B, 110 R

[56] References Cited

U.S. PATENT DOCUMENTS

| | | | |
|---|---|---|---|
| 2,725,232 | 11/1955 | Magida | 272/132 |
| 3,127,969 | 4/1964 | Hanson | 192/93 A |
| 3,596,907 | 8/1971 | Brighton | 272/131 |
| 3,640,530 | 2/1972 | Henson | 272/132 |
| 3,896,672 | 7/1975 | Henson | 272/125 |
| 3,929,331 | 12/1975 | Breeding | 272/125 |

*Primary Examiner*—Richard J. Johnson

*Attorney, Agent, or Firm*—D. A. N. Chase; Michael Yakimo, Jr.

[57] ABSTRACT

An isokinetic exercise device comprises in a linking arrangement first and second manually-operated members with a floating plate and brake assembly therebetween, all members mounted in rotation about a shaft member. A series of paired arcuate raceways, having a non-linear sloped profile, are located in the opposing faces of the floating plate and the first member. Captivation of a ball bearing between the raceways presents a driving connection for transmittal of forces, created by operator rotation of the first and second members, to the brake assembly. The brake assembly responds to such forces to retard rotation of the first and second members linked thereto, such retardation presented as a resistance to the user. A speed selector assembly provides for a selectable change in the location and attitude of the driving connection so as to control the efficacy of the driving connection which changes the degree of forces transmitted to the brake assembly. The brake assembly is functionally responsive to such changes so as to vary the retardation offered to the rotatable members and thus the resistance presented to the user. The speed selector accordingly provides selectable speeds of operation to the exercise device.

9 Claims, 11 Drawing Figures

Fig. 1.
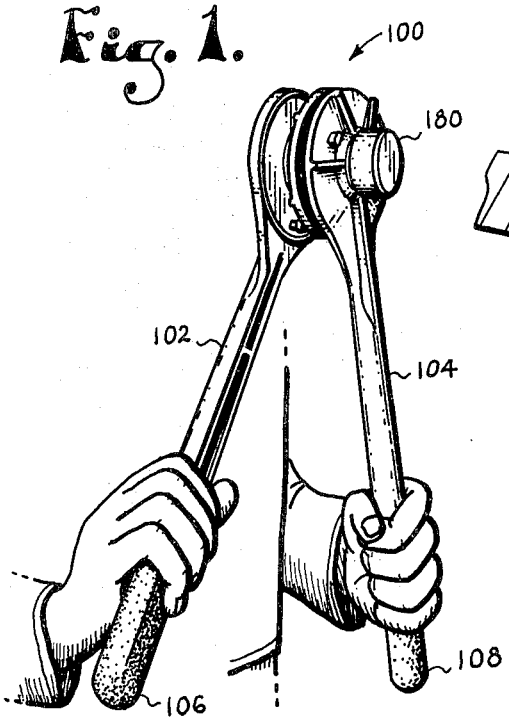
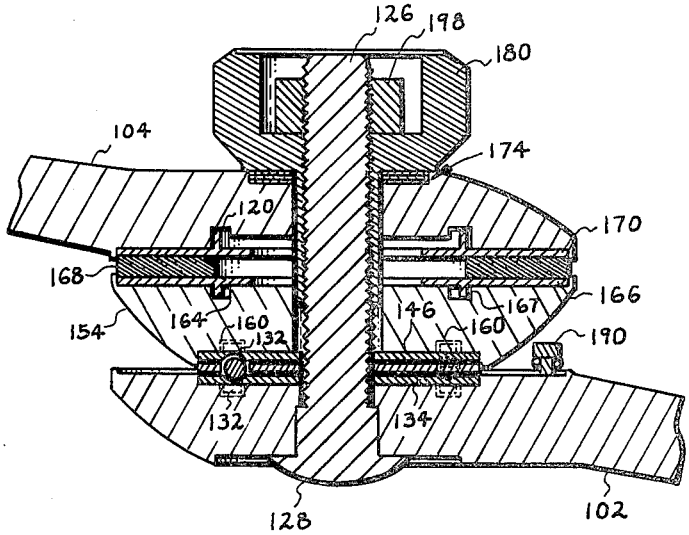
Fig. 2.
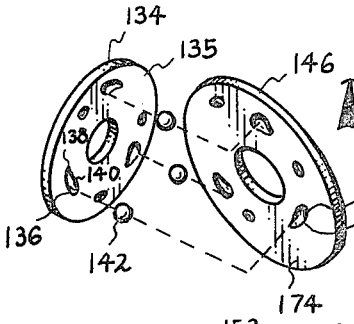
Fig. 3.
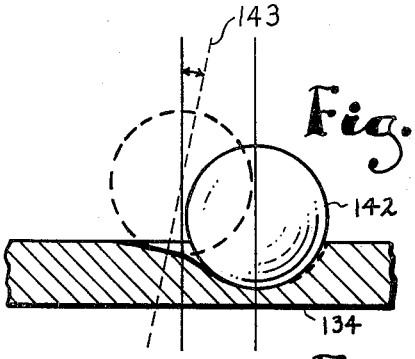
Fig. 10.
Fig. 4.
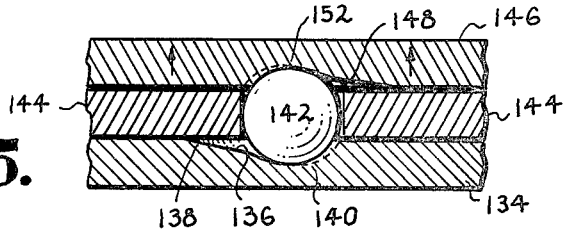
Fig. 5.
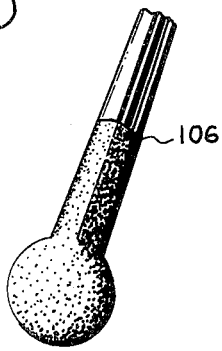
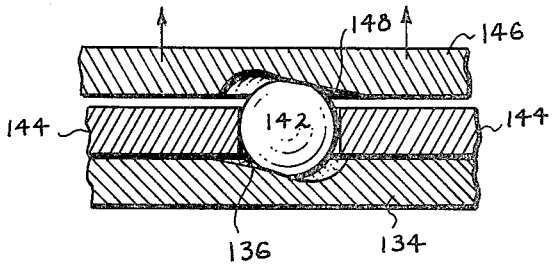
Fig. 6.

ISOKINETIC EXERCISE DEVICE WITH SPEED CONTROL

BACKGROUND OF THE INVENTION

This invention relates to an isokinetic exercise device and more particularly to an isokinetic device utilizing a speed control assembly for presenting a selectable number of operable speeds to the user.

As set forth in an embodiment of U.S. Pat. No. 3,929,331 entitled "Exercise Device" issued Dec. 30, 1975 which is hereby incorporated into this specification, an assembly is provided for use as an operator-energized, torque-responsive exercise device. This assembly includes a pair of mutually rotatable members having operator handles thereon with the members being mounted in a facing relationship with spreading means therebetween. The spreading means, in the form of spherical ball bearings, are positioned between paired arcuate raceways located in the facing services of the rotatable members. The raceways are aligned such that relative rotation of the members causes the ball bearings to move along their raceways until captivation therebetween so as to axially displace or spread apart the members. This spreading apart operates an associated brake assembly which in turn retards the rotation of the manually operated members. The retardation is presented as a resistance to the operator through the handles in an amount proportional to the force applied there to which provides an isokinetic exercise corresponding to the strength capability of the operator.

These devices have been limited in their range of use as there has been no means to selectably adjust the speeds at which the exercise device could be operated. This absence of a speed adjustment limited the effective user of a particular exercise device only to those users initially having the strength to operate the device at the inherently designed single speed.

The present invention provides for an exercise device which utilizes a speed control assembly allowing the user to select a speed of operation by adjusting the axial distance between the paired arcuate raceways prior to the start of the exercise movement. This selectable axial distance affects the position of the ball bearings along the raceways at captivation, the paired raceways being particularly designed to change the angle of contact between the captivated balls and the raceways. In turn, this angle of contact controls the intensity of forces delivered to the associated brake assembly upon operation of the exercise device and the ultimate resistance presented to the operator. Accordingly, a range of speeds of operation of the device are provided which allows a single exercise device to be used by operators of diverse strengths without the need to change the critical design parameters incorporated therein.

It is therefore a general object of this invention to provide an isokinetic exercise device having a speed control assembly incorporated therein which allows a user to selectably set the speed at which the device can be effectively operated.

Another object of this invention is to provide an isokinetic exercise device, as aforesaid, which can be operated by a wide range of users of various strength capabilities.

Still another object of this invention is to provide an isokinetic exercise device, as aforesaid, which is rugged in construction so as to withstand the forces acting thereon during performance of the exercise.

A further object of this invention is to provide an isokinetic exercise device, as aforesaid, which has a plurality of selectable ranges of resistance designed therein which can be selectably offered to the user.

A particular object of this invention is to provide an isokinetic exercise device, as aforesaid, utilizing ball bearings captivated in paired arcuate raceways to provide a driving connection among the linked elements of the device.

Another particular object of this invention is to provide an isokinetic exercise device, as aforesaid, having means therein to regulate the location of the ball bearings at captivation, in order to control the mechanics of the driving connection offered thereby.

Still another particular object of this invention is to provide an isokinetic exercise device utilizing ball bearings captivated in paired arcuate raceways, as aforesaid, the raceways particularly designed to change the contact angle of the ball bearings therein to control the mechanics of the driving connection offered thereby.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 1 is an elevation view showing the exercise device as held by the operator at the initiation of the exercise operation.

FIG. 2 is a sectional elevational view, on an enlarged scale, showing the linking arrangement of the elements of the exercise device.

FIG. 3 is a perspective view showing the first and second ball ramp plates and the relationship between the paired arcuate raceways and ball bearings to be capitvated therebetween.

FIG. 4 is a fragmentary view showing an alternative handle member of the exercise device.

FIG. 5 is a sectional elevation view, on an enlarged scale, showing the relationship between the ball bearing and the associated paired raceways at the fastest speed of operation of the exercise device.

FIG. 6 is a sectional elevation view, on an enlarged scale, showing the relationship between the ball bearing and the associated paired raceways at the slowest speed of operation.

FIG. 10 is a sectional elevation view of one of the ball ramp plates with the ball bearing seated therein showing the non-linear slope profile of the arcuate raceway, as well as the change of the angle of contact of the ball bearing with the raceway during movement therealong.

DESCRIPTION OF THE PREFERRED EMBODIMENT

Figure 7:
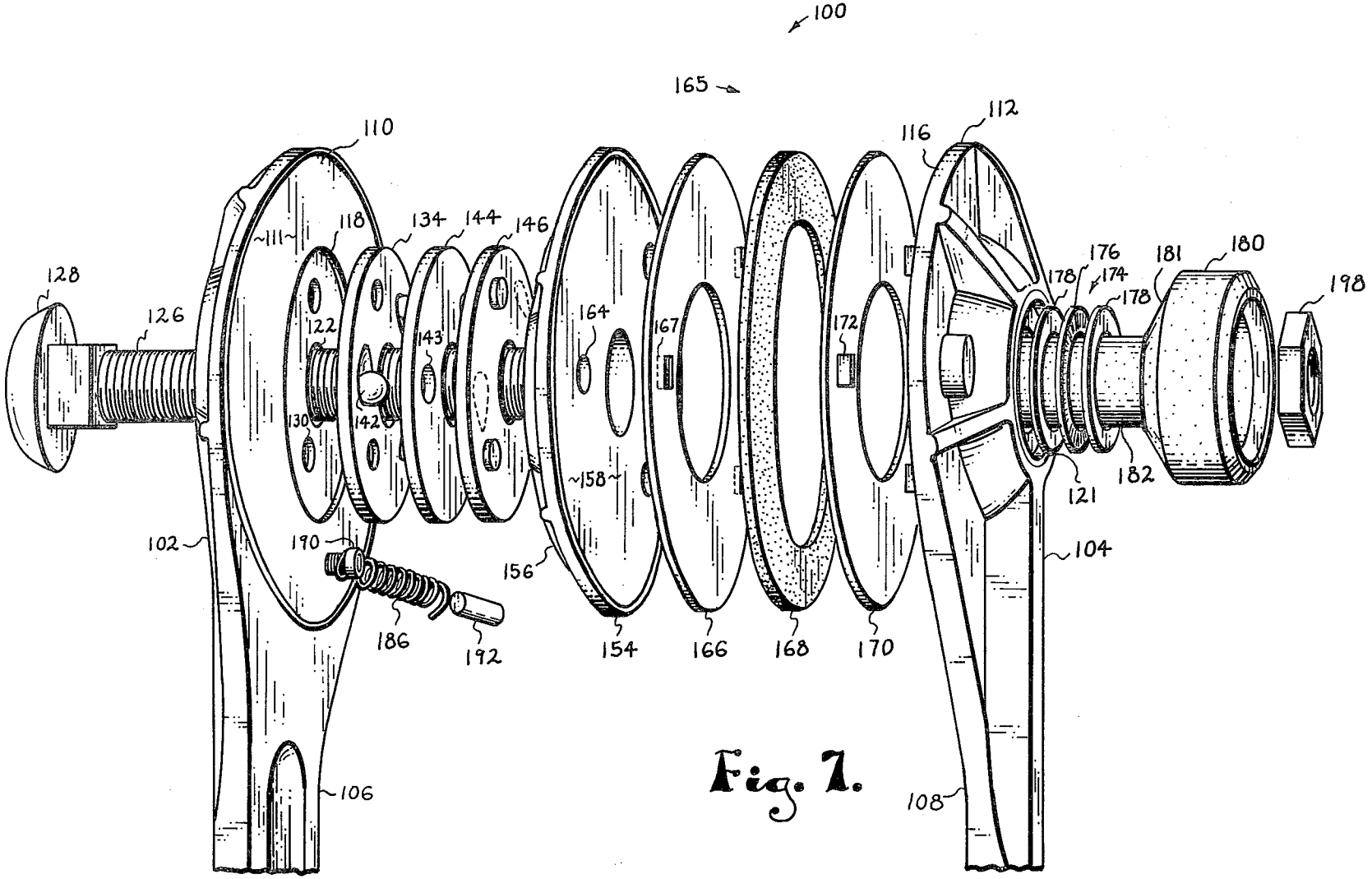
FIG. 7 is an exploded elevation view showing the arrangement of elements of the exercise device about the common axis of rotation.

Referring more particularly to the drawings the exercise device 100 comprises first 102 and second 104 operator-rotatable members each having a user handle 106 and 108 extending from plate-like portions 110 and 112 located at one end thereof. As shown, the inboard surface 111 of plate member 110 is substantially planar and includes a cylindrical recess 118 at the center thereof. A bolt aperture 122 within the recess 118 allows for projection of an elongated threaded bolt or shaft 126 therethrough. At one end of shaft 126 is a flared bolt head 128 which engages the outboard surface of the plate portion 110.

Within recess 118 are positioned a series of three angularly-spaced orifices 130 radially equidistant from the center of aperture 122. The orifices 130 are designed to receive therein the nipples 132 of a circular, first ball ramp plate 134.

The first ball ramp plate 134 is of a diameter approximating that of the recess 118 and has on the inboard surface 135 thereof a series of three angularly displaced ramps or races 136 equidistant from the center thereof. Each race 136 is generally arcuate in configuration and increases in depth in a non-linear manner along its arcute length from the tail 138 to the head 140 thereof. Positioned within each race 136 is a spherical ball bearing 142, the angle of contact between the ball 142 and race 136 changing as the ball 142 travels along the race 136 due to the non-linear profile of the race 136 as shown in FIG. 10. A circular ball separator plate 144 having a series of three apertures 143 therein, corresponding to the respective ball bearings 142, receives a portion of each respective ball bearing 142 therethrough.

A second circular ball ramp plate 146 is identical in configuration to the first ball ramp plate 134. The inboard surface 147 of ball ramp plate 146 is placed in a facing relationship with the inboard surface 135 of the first ball ramp plate 134 so as to present a paired relationship between corresponding races 136 and 148 with the ball bearing 142 located therebetween. This paired relationship is best seen in FIGS. 5 and 6, showing that the arcuate races 136 and 148 extend in opposite directions and decrease in depth therealong as referenced by general alignment of the head portions 140 and 152 thereof.

A circular floating plate 154, so named for its intended axial movement along shaft 126 has on the inboard surface 156 a series of angularly positioned orifices 160 for receiving the protruding nipples 132' of the second ball ramp plate 146 therein. The outboard surface 158 of floating plate 154 is a substantially planar face with a series of three angularly spaced orifices 164 therein.

On this outboard surface 158 is placed a brake assembly comprising a first circular ring-like friction plate 166, made of a high polished metal material, having a series of three projecting lugs 167 for insertion into the orifices 164. A ring-like brake pad 168 made of a teflon material is then placed atop the friction plate 166 with a second friction plate 170 placed on the top thereof with the lugs thereon 172 projecting away from the brake pad 168.

A second member 104 having an elongated handle 108 with a plate section 112 at one end thereof is slipped over the shaft 126. The inboard surface 116 of plate 112 has a series of three recesses 120 thereon for receiving the projecting lugs 172 of the second friction plate 170.

On the outboard surface of handle 108 is a cylindrical recess 121 designed for positioning the needle bearing 174 assembly therein, such assembly including the bearing proper 176 inserted between two washer members 178.

A speed selector knob 180 having an elongated throat 182 threadably engages the elongated shaft 126 with the lower lip 181 of the knob 180 abutting the needle bearing assembly 174. The needle bearing 174 allows for rotation of the second member 104 relative to a fixed position of the abutting speed selector knob 180. A head nut 198 threadably engages shaft 126 for restraining movement of the knob 180 towards the free end of the shaft 126. Positioning the knob 180 on shaft 126, the common axis of rotation for the above-described elements, maintains these elements in the above-described linking arrangement and as shown in FIG. 2.

Finally, a spring member 186 with pin member 192 therein is attached between an upstanding post 190 projecting from the first plate member 110 and the floating plate 154. Within the spring 186 and lying along the central axis thereof is a cylindrical pin member 192, the purposes of the spring member 186 and of the pin member 192 are to be subsequently described.

OPERATION

In operation, user rotation of the speed selector knob 180 about the threaded shaft 126 controls an axial movement of the knob 180 and floating plate 154 along the shaft 126 due to the linked relationship therebetween. This axial movement of the floating plate 154 provides for a concurrent change in the distance between the first and second ball ramp plates 134 and 146.

Figure 8:
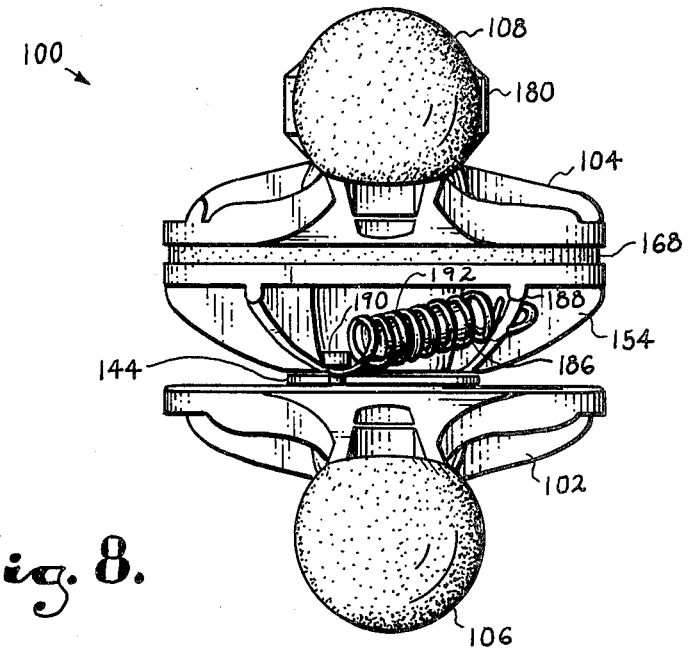
FIG. 8 is an elevation view of the exercise device, taken from the ends of the aligned handles thereof and in reference to FIG. 5, showing the relationship of the visible elements of the exercise device at the fastest speed of operation.
Figure 9:
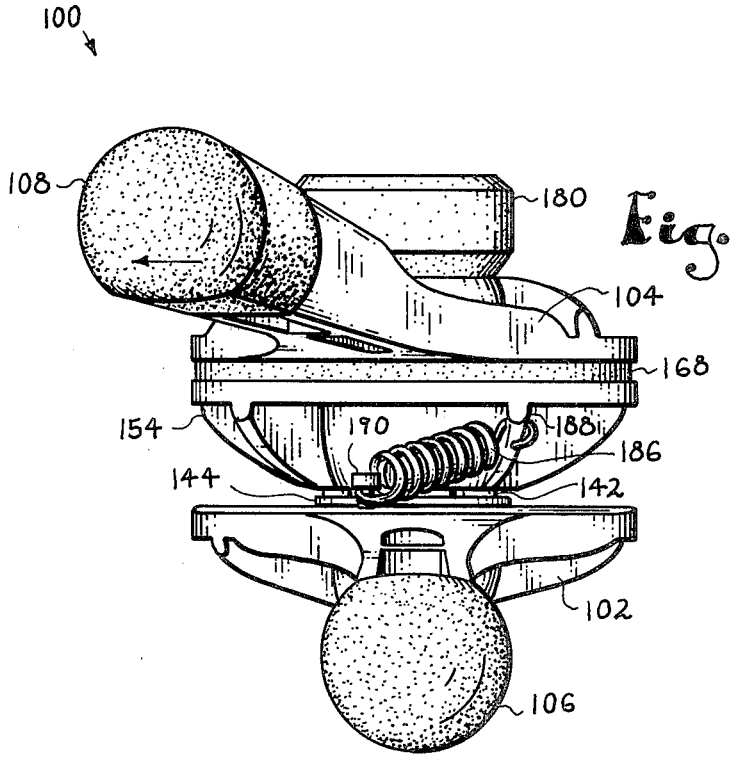
FIG. 9 is an elevation view of the exercise device, taken from the end of the non-aligned handles thereof and in reference to FIG. 6, showing the relationship of the visible elements of the exercise device at the slowest speed of operation.
Figure 11:
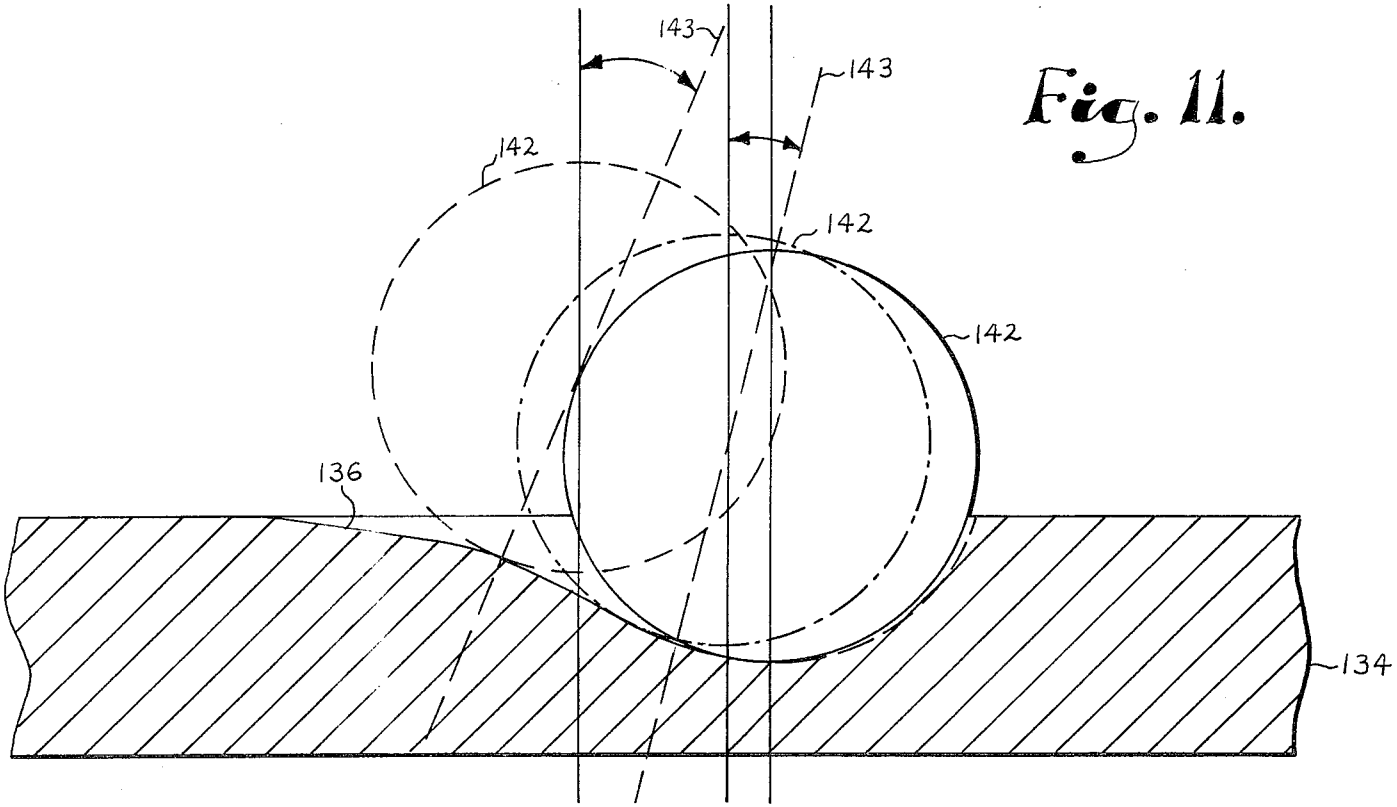
FIG. 11 is a diagrammatic view, on an enlarged scale, illustrating the non-linear slope profile of the arcuate raceway, as well as the change of the angle of contact of the ball bearing with the raceway during movement therealong.

As shown in FIGS. 8 and 9, the spring member 186 is attached between a rib 188 on the floating plate 154 and an upstanding post 190 located on the inboard surface 111 of the first plate member 110. This spring member 186 urges the floating plate 154 and second ball ramp plate 146 embedded therein into rotatable movement about the shaft 126, the direction of movement determined by a stretching and compression of the spring 186.

Selecting as a point of reference, the closest axial distance between the ball ramp plates 134 and 146, as diagrammatically shown in FIG. 5, rotation of the speed selector knob 180 in a counterclockwise direction about shaft 126 causes an axial displacement of the ball ramp plates 134 and 146. At the position shown in FIG. 5, the spring member 186 is at an extended or stretched position as shown in FIG. 8. Accordingly, upon movement of the selector knob 180 away from the first ball ramp plate 134 and towards the end of the shaft 126, the spring 186 seeks to return to its normal position. This spring bias rotates the floating plate 154/second ball ramp plate 146 in a clockwise rotation about shaft 126, such rotation being relative to the stationary first ball ramp plate 134. This relative rotation moves the balls 142 along their respectively paired raceways 136 and 148 into the captivated position shown in FIG. 6 which causes the above-mentioned axial displacement. The degree of rotation of the floating plate 154/second ball ramp plate 146 is limited by the captivation of the balls 142 therebetween. The ball separator plate 144 provides a synchronization among the travel of the three balls 142 along their respectively paired raceways in order to assure that each ball 142 is at an identical relative position. The speed selector knob 180 upon rotation to an endpoint position as defined by head nut 188 incrementally moves the balls 142 to that position shown in FIG. 6. At this position the spring member 186, as shown in FIG. 9, is relatively compressed compared to the stretched position in FIG. 8, due to the relative rotation of the floating plate 154/ball ramp plate 146 as shown in FIG. 9.

Conversely, from a referenced position as shown in FIG. 6, clockwise rotation of the knob 180 about shaft 126 causes movement of the floater plate 154/second ball ramp plate 146 towards the first ball ramp plate 134. The resulting forces transmitted to the balls 142 causes the balls 142 to seek movement along their paired raceways towards the captivated position as shown in FIG. 5. This ball 142 movement urges the floating plate 154/second ball ramp plate 146 into counterclockwise rotation about shaft 126, as limited by the captivation, which in turn stretches the bridging spring member 186. Turning of the knob 180 to the other of the endpoint positions moves the balls 142 to that position shown in FIG. 5, the spring member 186 being stretched as shown in FIG. 9.

Accordingly, it can be seen that the speed selector knob 180 cooperates with the action of the bridging spring member 186 to provide an association between displacement of the first and second ball ramp plates 134 and 146 and relative rotation therebetween. This relative rotation further positions the balls 142 at selected positions along their respectively paired raceways 136 and 148. Furthermore, the bias offered by the spring member 186 maintains the balls 142 at their operator-selected position.

As above-explained, axial adjustment of the speed selector knob 180 moves the balls 142 along their respectively paired raceways 136 and 148 for captivation therebetween. This provides a driving connection for forces transmitted thereto by the user through handles 106 and 108.

Upon movement of the handles 106 and 108, one towards the other from the position shown in FIG. 1, forces exerted by the operator are transmitted through this driving connection into the brake assembly 165 linked thereto. These forces urge the friction plates 166 and 170 against the brake pad 168 which in turn offers resistance to the rotation of the handles 106 and 108 by the operator. Due to the unique linking arrangement of the elements, as above described and as shown in FIG. 2, the application of increasing forces to the respective handles 106 and 108 by the user results in increasing forces on the brake assembly 165 retarding rotation of members 102 and 104 which in turn presents an increasing isokinetic-type resistance to the user.

Basically the speed of operation of these devices have been influenced by the coefficient of friction of the braking elements 166, 168 and 170, the effective mean radius of these braking elements and the radius of the arcuate raceways 136 and 148. Passage of the operator-produced forces through the driving connection, as provided by the lodged balls 142, occur along a central line of thrust 143 diametrically passing therethrough. Previous devices have failed to appreciate the significance of varying the angle of contact of the balls 142 with the surface of their raceways 136 and 148 which, in effect, determines the attitude of the central line of thrust 143 and forces therealong relative to the linked brake assembly 165.

Previously, this angle of contact of the balls 142 has remained the same due to the linear profile of the raceways 136 and 148 during their progression from the head portion 140 to the tail portion 138 thereof. Due to this linear profile, the angle of contact of the balls 142 moving therealong remains fixed which effected a fixed response by the associated braking assembly. Thus, due to the fixed angle of contact, only one speed was possible, as the ultimate resistance presented to the user by the braking assembly did not significantly vary.

I have found that the use of arcuate raceways having a non-linear profile, as shown in FIG. 10, changes the angle of contact of the balls 142 during their movement along the paired raceways 136 and 148. This in turn changes the attitude of the central line of thrust which variously affects the degree of response of the braking assembly 165. Accordingly, as shown in FIG. 5, the angle of contact of the balls 142 at the point of driving connection is at a minimum, as measured relative to a vertical diameter passing therethrough which affects a minimal response of the associated braking assembly 165. Accordingly, a minimal resistance to user rotation of the handles 106 and 108 is presented which corresponds to the fastest allowable user speed of the device 100.

As the balls 142 progress along their respectively paired raceways 136 and 148 to that point shown in FIG. 6, the angle of contact increases which in turn increases the response of the braking assembly 165 and ultimately the degree of resistance presented to the user. The position as shown in FIG. 6 corresponds to the greatest resistance offered to the user and thus the slowest speed of operation of the device 100, i.e., the movement of handles 106 and 108 one towards the other.

Accordingly, it can be seen that the speed selector knob 180, as above described, is effective in placing and maintaining the balls at and between the end points shown in FIG. 5 and FIG. 6 so as to vary the angle of contact of the balls 142 with their respective raceways 136 and 148 which in turn ultimately offers a selectable degree of resistance or speed of operation of the exercise device 100 to the user.

As shown in the diagrammatic profile in FIGS. 5 and 6 and more particularly in FIG. 10, the slope of the raceways 136 and 148 tend to flatten at the respective tail ends thereof. The flattened slope of this selected profile compensates for the play in the compressed spring 186 at the position shown in FIGS. 6 and 9 and those positions approaching thereto. This play in the spring member 186 slightly compresses the spring 186 upon movement of the handles 106 and 108 one towards the other, which in effect, slightly moves the balls 142 further along their paired raceways before captivation of the balls 142 and the driving connection is realized. Thus, the change in slope at these points has been made slight so that the angle of contact remains effectively the same. Thus, the slight change, if any, in the angle of contact of the balls 142 from the selected position will be negligible so as not to be noticed by the user.

Furthermore, as a safety precaution, the spring member 186 has a cylindrical pin 192 therein which contacts the rib 188 of the floating plate 154 in those instances in which a very strong user is able to quickly move the handles 106 and 108 one towards the other. This abuttment of the cylindrical pin member 192 against the rib 188 transfers the forces from the spring 186 to the floating plate 154 so as to prevent breakage of the spring member 186.

Although the above speed control assembly has been described in reference to the device 100 of FIG. 1, it is understood that it is adaptable to other embodiments of isokinetic devices using equivalent elements as above described. For example, it is adaptable to that device shown in the incorporated patent so as to restrict the degree of movement of the balls 34 along their paired raceways 35, which in turn restricts the axial displacement of the disc member 23 so as to ultimately effect the degree of response on that brake assembly as provided by friction plates 25 and 26.

Accordingly, it is to be understood that while certain forms of this invention have been illustrated and described, it is not to be limited thereto, accept in so far as such limitations are included in the following claims.

Having thus described the invention, what is claimed as new and desired to be secured by Letters Patent is:

1. An exercise device comprising:

a first plate member;

a second plate member;

a shaft member extending between said first and second members and presenting a common axis of rotation;

handle means on at least one of said plate members for providing a user rotation thereto;

a floating plate interposed between said plate members in axial and rotatable movement relative to said shaft;

a series of angularly spaced and paired arcuate raceways positioned adjacent the opposing faces of one of said plate members and said floating plate, each raceway of said pair of raceways aligned in a generally opposed relationship therebetween;

ball means movable along said paired raceways;

means for captivating said ball means between said paired raceways at a selectable point of contact therealong, said captivation providing a driving connection between said floating plate and said one plate member for transmittal of forces produced by said user rotation;

brake means operably associated with said floating plate and one of said plate members and positioned in a force communicating relationship with said driving connection in a manner to be operably responsive to said transmitted forces, said operable response retarding said user rotation of at least said plate member; and means for changing the angle of contact of said captivated ball means with said paired raceways as presented by said raceways having a generally non-linear slope profile between the opposed ends thereof, said respective angle of contact changing said relationship between said brake means and said driving connection to effect the degree of said brake means operable response and said retardation to said user rotation.

2. The exercise device as claimed in claim 1, wherein said captivation mean comprises:

means for selectably controlling the axial distance between said paired raceways, said ball means moving along said paired raceways in a first direction in response to a reduction of said axial distance, said first ball means movement providing a first relative rotation between said raceways of said floating plate and said one plate member in a first direction; and bias means providing a second opposed relative rotation between said raceways of said floating plate and said one plate member and operable upon an increase in said axial distance for moving said ball means in a second opposed direction along said paired raceways, said raceways relatively rotating to provide said ball means movement until captivation of said ball means between said raceways at a location presenting said selectable axial distance at said selectable point of contact therebetween.

3. The exercise device as claimed in claim 2, wherein said control means comprises a knob member linked to said floating plate, said knob member axially movable along said shaft by said user for providing like axial movement of said floating plate and said associated raceways relative to said one plate member whereby to define and controlled axial distance.

4. The exercise device as claimed in claim 2, wherein said bias means comprises a spring member connecting said floating plate and said one rotatable member, said spring member storing energy therein upon said reduction of said axial distance and releasing said energy upon said increase in said axial distance to provide for said second relative rotation of said associated raceways.

5. The exercise device as claimed in claim 1, wherein said slope profile of said paired raceways generally increases said angle of contact of said ball means upon movement of said ball means in a first direction along said raceways and generally decreases said angle of contact of said ball means upon movement of said ball means in a second direction along said raceways opposite said first direction, whereby said relationship between said driving connection and said brake means changes according to said increase or decrease in said angle of contact to relatively effect said transmittal of forces therebetween and said degree of said brake means operable response.

6. The exercise device as claimed in claims 1, 2, 3, 4 or 5, wherein said brake means comprises:

first and second brake plates;

a brake pad interposed between said first and second brake plates;

means for joining said first brake plate to said floating plate in movement therewith;

means for joining said second brake plate to said adjacent plate member in movement therewith, said brake plates operably responsive to said transmitted forces in engagement against said brake pad whereby to resist rotatable movement of said floating plate and at least said adjacent rotatable member respectively linked thereto.

7. The exercise device as claimed in claim 1, wherein said ball means are spherical ball bearings and said exercise device further comprises:

a ball separator plate mounted between said floating plate and said one member in rotation about said common axis; and a series of angularly-spaced apertures in said separator plate for receiving said ball bearing therethrough, said ball separator plate rotatably responsive to said movement of said ball bearings along said paired raceways whereby to synchronize said ball movement therealong.

8. An exercise device comprising:

a support member;

first and second members disposed in a face-to-face relationship on said support member with at least one of said members mounted in rotation about a common axis;

means for restraining axial movement of said first and second members along said common axis;

handle means connected to said rotatable members for providing operator movement of said rotatable members during the performance of an exercise operation;

a series of angularly-spaced raceways associated with the inboard faces of said first and second members and positioned such that the raceways of said first member are substantially aligned with the raceways of said second member;

ball means captivated within said aligned raceways upon said rotation and establishing a driving connection for transmittal of forces produced by said operator on said handle means;

a brake assembly mounted on said support member adjacent one of said first and second members and in operable communication with said driving connection, said brake assembly operable by said forces transmitted along said driving connection to retard rotation of said rotatable members and movement of said handle means; and means for changing the angle of contact of said captivated ball means with said paired raceways, said angle of contact changing the relationship of said driving connection with said brake assembly and the transmittal of said forces therebetween for affecting the efficacy of said driving connection and the degree of said operation of said brake assembly.

9. An exercise device comprising:

a first rotatable member;

a second rotatable member;

a shaft member extending between said first and second members and presenting a common axis of rotation;

handle means on at least one of said members for providing a user rotation thereto;

a floating plate interposed between said first and second members in axial and rotatable movement relative to said shaft;

a series of paired arcuate raceways having a non-linear sloped profile thereto and positioned adjacent the opposing faces of one of said rotatable members and said floating plate and disposed in a generally aligned relationship therebetween;

ball means movable along said paired raceways and captivated therebetween upon a relative rotation between said raceways about said common axis, said captivation providing for a driving connection between said floating plate and said one member for transmittal of forces produced by said user rotation therethrough;

brake means interposed between said floating plate and the other of said rotatable members, said brake means operably responsive to said transmittal of forces so as to retard user movement of at least said handle means linked to said other rotatable member; and means for selectably angularly positioning said captivated ball means between said paired raceways to change the relationship of said driving connection with said brake means and the transmittal of forces along said driving connection to said brake means whereby to control the effect of said forces transmitted to said brake means and said brake means response.

* * * * *

UNITED STATES PATENT AND TRADEMARK OFFICE

CERTIFICATE OF CORRECTION

PATENT NO. : 4,374,588

DATED : February 22, 1983

INVENTOR(S) : ROGER RUGGLES

It is certified that error appears in the above—identified patent and that said Letters Patent is hereby corrected as shown below:

Claim 3:

Column 8, Line 19, change "and" to --said--.

Signed and Sealed this

*Twenty-fourth* Day of *May 1983*

[SEAL]

*Attest:*

DONALD J. QUIGG

*Attesting Officer* *Acting Commissioner of Patents and Trademarks*